US006018951A

United States Patent [19]

Rudiger

[11] Patent Number: 6,018,951

[45] Date of Patent: Feb. 1, 2000

[54] REFRIGERATING AND SHIPPING CONTAINER

[75] Inventor: Horst Rudiger, Augsburg, Germany

[73] Assignee: Linde Aktiengesellschaft, Germany

[21] Appl. No.: 08/957,579

[22] Filed: Oct. 24, 1997

[30] Foreign Application Priority Data

Oct. 25, 1996 [DE] Germany ..... 196 44 440

[51] Int. Cl.[7] ..... F25D 3/14

[52] U.S. Cl. ..... 62/51.1; 62/457.7

[58] Field of Search ..... 62/457.7, 457.9, 62/51.1

[56] References Cited

U.S. PATENT DOCUMENTS

| | | | |
|---|---|---|---|
| 1,950,905 | 3/1934 | Rubin | 62/457.9 |
| 3,059,452 | 10/1962 | Griffin | 62/457.7 |
| 3,693,371 | 9/1972 | Clark | 62/51.1 |
| 4,129,432 | 12/1978 | Garside | 62/51.1 |
| 4,206,609 | 6/1980 | Durenec | 62/51.1 |
| 4,319,629 | 3/1982 | Hotta | 62/457.7 |
| 4,802,345 | 2/1989 | Curtis | 62/51.1 |
| 5,417,072 | 5/1995 | Silver et al. | 62/51.1 |
| 5,692,379 | 12/1997 | Gallivan et al. | 62/51.1 |

*Primary Examiner*—William E. Tapoical
*Attorney, Agent, or Firm*—Millen, White, Zelane, & Branigan, P.C.

[57] ABSTRACT

A refrigerating and shipping container for refrigerated goods, whereby said container is made heat-insulated, with a door or a cover and with a refrigeration supply. According to the invention, a wall of the container has an indentation into which a cold finger of a refrigeration supply fits.

11 Claims, 1 Drawing Sheet

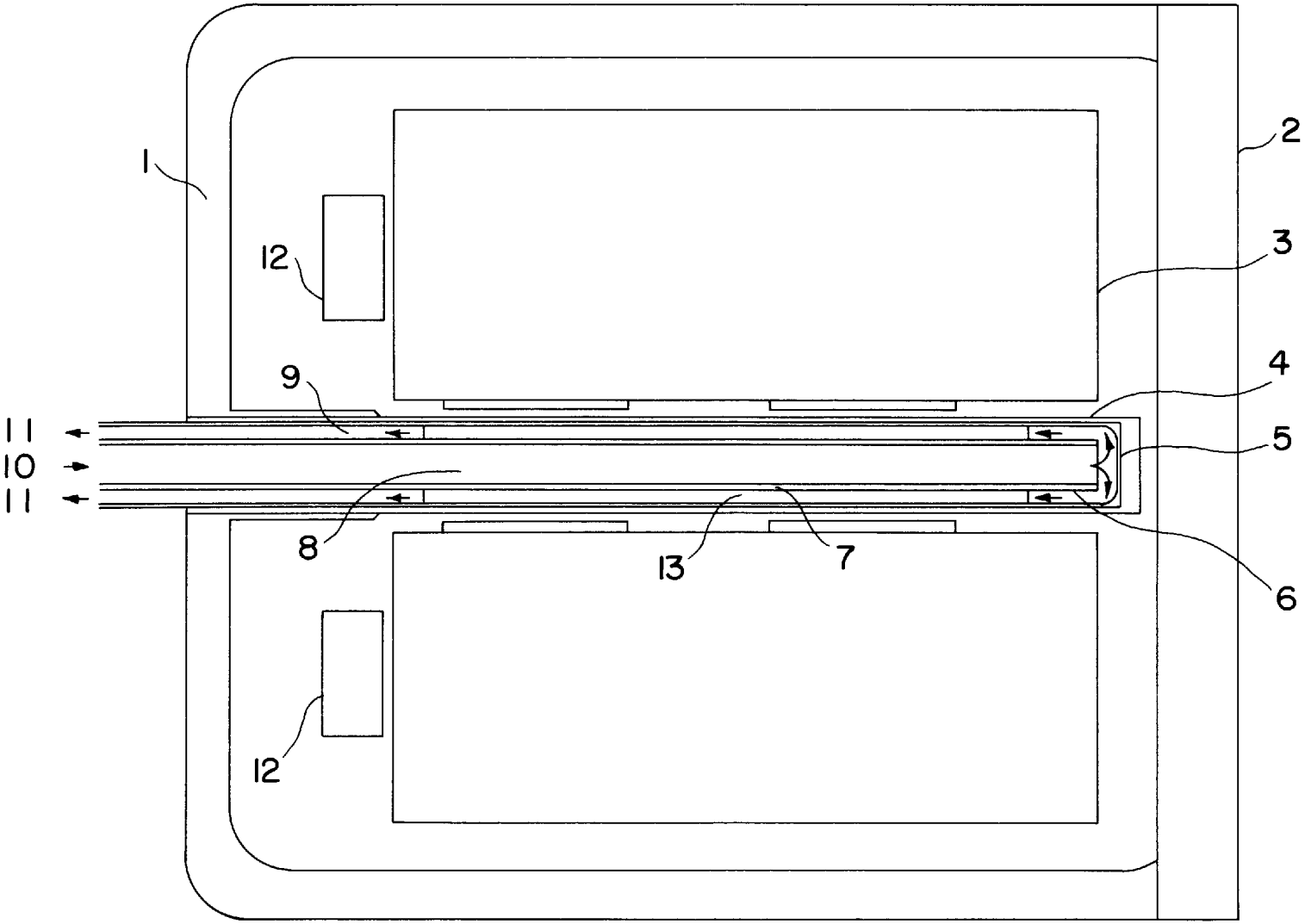
2
3
4
5
6
7
13
12
9
8
12
1
10

REFRIGERATING AND SHIPPING CONTAINER

BACKGROUND OF THE INVENTION

The invention relates to a refrigerating and shipping container for refrigerated goods, whereby said container is made heat-insulated, with a door or a cover and with a refrigeration supply.

Refrigerating and shipping containers according to the preamble of claim 1 are known in the form of, for example, coolships, refrigerated cars, or refrigerated trucks. They have a permanently installed active refrigeration supply and can therefore be operated without the need for external devices over prolonged shipping times. They must carry this refrigeration supply with them, however. This drawback is all the more significant, the larger the proportion of mass for which the refrigeration supply accounts in the total mass shipped, such as, e.g., when small amounts of refrigerated goods are shipped at low temperatures.

SUMMARY OF THE INVENTION

The object of the invention is therefore to propose a refrigerating and shipping container that is suitable for such cases for the refrigerated goods.

Upon further study of the specification and appended claims, further objects and advantages of this invention will become apparent to those skilled in the art.

Characteristic of the invention is that a wall of the container has an indentation into which a cold finger of the refrigeration supply fits. This cold finger ensures, on the one hand, good thermal contact between the refrigeration supply and the refrigerating container with the possibility of active refrigeration, but on the other hand, makes it quick and simple to separate the refrigeration supply from the container in order to ship the container and to connect it to another refrigeration supply at its destination.

The cold finger of the refrigeration supply can be cold inside. This has the advantage of ensuring better heat removal from the surface into the interior of the cold finger.

Refrigeration can advantageously be carried out in such a way that a fluid is evaporated and/or heated in the cold finger.

The fluid, which is evaporated and/or heated in the cold finger, is advantageously supplied from a refrigeration unit and flows back into the latter to be reliquefied and/or recooled. This makes it possible to ensure permanent active refrigeration, as long as the container is being stored, i.e., not being shipped.

In addition to the refrigerated goods, the refrigerating and shipping container can also hold cold-storage goods, which increases the length of time that goods can be shipped without active refrigeration just as much as does improving the insulation of the container, which is frequently more expensive.

BRIEF DESCRIPTION OF THE DRAWINGS

Various other objects, features and attendant advantages of the present invention will be more fully appreciated as the same becomes better understood when considered in conjunction with the accompanying drawing, in which like reference characters designate the same or similar parts throughout the several views, and wherein:

FIG. 1 is a sectional image of the refrigerating and shipping container.

DESCRIPTION OF THE PREFERRED EMBODIMENT

The invention is explained in more detail based on an embodiment with FIG. 1. The FIGURE shows diagrammatically a sectional image of the refrigerating and shipping container according to the invention. A vacuum-insulated double-walled container 1 with a cover 2 forms an enclosure. The goods holds refrigerated goods 3 in a space defined by the enclosure. The goods are arranged with good heat contact around an indentation 4, which is depicted in the FIGURE as a recess defining a cavity projecting into the space defined by the enclosure of the container 1. A probe in the form of a cold finger 5, which contains a coaxial double-walled pipe 6 which is open on the right side and whose gap 7 is evacuated, projects into the cavity of the recess and thus into the space containing the goods. The interior space of the cold finger is divided into two spaces that are thermally insulated from one another, namely into a tubular space 8 and an outer annular space 9, by double-walled pipe 6. The tubular space is used to feed cold nitrogen 10 from a refrigeration unit (not shown in the FIGURE). The nitrogen is diverted at the end of pipe 6 into outer annular space 9 and heated by heat exchange with the inside wall of cold finger 5. Heated nitrogen 11 is returned to the refrigeration unit (not shown in the FIGURE).

To improve the removal of heat from refrigerated goods 3, container 1 can contain, for example, two circulating blowers 12. A corrugated metal strip 13 in annular space 9 improves heat transfer from cold finger 5 to the nitrogen that flows into annular space 9.

It is not shown in the FIGURE that in its left part cold finger 5 is designed to be vacuum-insulated from its surroundings.

The entire disclosure of all applications, patents and publications, cited above and below, and of corresponding German Application 196 44 440.3, filed Oct. 25, 1996, is hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A refrigerating and shipping container cooperating with a refrigeration unit for cooling and maintaining a low temperature of refrigerated goods, comprising:

an insulated enclosure defining a space therewithin for receiving the refrigerated goods which are placed in and removed from the space in the enclosure through a door or cover, a recess extending into the space defining a cavity for receiving a probe;

a probe configured as a cold finger removably inserted into the cavity and extending, while in said cavity, into the space;

the cold finger being connected to the refrigeration unit for receiving circulatory refrigerant to cool and maintain a low temperature of the goods in the space while the container is being stored, whereby the container is disconnectable from the refrigeration unit by removing the cold finger from the cavity when the cavity transported.

2. Refrigerating and shipping container according to claim 1, wherein the cold finger of the refrigeration supply is cooled on the inside.

3. Refrigerating and shipping container according to claim 1, wherein a fluid is evaporated and/or heated in the cold finger.

4. Refrigerating and shipping container according to claim 1, wherein the fluid flows from a refrigerating unit into the cold finger and is evaporated and/or heated and flows back into a refrigerating unit to be reliquefied and/or recooled.

5. Refrigerating and shipping container according to claim 1, wherein in addition to the refrigerated goods, the container also holds cold-storage goods.

6. A refrigerating and shipping container according to claim 3, wherein the fluid flows from the refrigerating supply into the cold finger and is evaporated and/or heated and flows back into the refrigerating unit to be reliquefied and/or recooled.

7. A refrigerating and shipping container for refrigerated goods, comprising:

at least one thermally insulated wall, a door or cover, at least one recess in said wall into which at least one cold finger of a refrigeration supply unit is removably inserted, whereby said cold finger has one closed-end and serves as a conduit for a refrigerating fluid to circulate and for removing heat from the container.

8. A refrigerating and shipping container as recited in claim 7, wherein said cold finger houses a coaxial double-walled pipe having an open end and dividing the interior of said cold finger into two spaces, a first space defined by the interior of said pipe, a second space defined by the annular space exterior to said pipe, whereby the refrigerating fluid flows from the refrigeration supply unit through said first space, then through the annular space, and is heated and/or evaporated and flows back to the refrigeration supply unit to be reliquefied and/or recooled.

9. A refrigerating and shipping container as recited in claim 8, wherein said double-wall pipes includes an evacuated space which provides thermal insulation between said first space and said second annular space.

10. A refrigerating and shipping container as recited in claim 9, wherein said cold finger includes a corrugated metal strip disposed in said annular space for improving heat transfer from said cold finger to the refrigerating fluid that flows therein.

11. A refrigerating and shipping container as recited in claim 10, further includes at least one circulating blower to improve the heat removal of the refrigerated goods in the container.

* * * * *